US005691283A

United States Patent [19]

Poat et al.

[11] Patent Number: 5,691,283

[45] Date of Patent: Nov. 25, 1997

[54] USE OF TRANSMISSION AND GEAR OIL LUBRICANTS HAVING ENHANCED FRICTION PROPERTIES

[75] Inventors: Julia C. Poat, Bracknell; Graeme M. Wallace, Wokingham; David Kenvyn Walters, Camberley, all of England; Ian Macpherson, Richmond, Va.

[73] Assignee: Ethyl Petroleum Additives Limited, Bracknell, England

[21] Appl. No.: 483,354

[22] Filed: Jun. 7, 1995

Related U.S. Application Data

[63] Continuation-in-part of Ser. No. 203,817, Mar. 1, 1994, Pat. No. 5,492,638.

[51] Int. Cl.[6] ..... C10M 137/10; C10M 135/10

[52] U.S. Cl. ..... 508/186; 508/322; 508/391; 508/420; 508/460; 508/542

[58] Field of Search ..... 508/332, 391, 508/420, 460, 186, 542

[56] References Cited

U.S. PATENT DOCUMENTS

| | | | |
|---|---|---|---|
| 4,218,330 | 8/1980 | Shubker | 508/186 |
| 4,917,809 | 4/1990 | Zinke et al. | 508/269 |
| 5,037,567 | 8/1991 | Farng et al. | 508/346 |
| 5,110,488 | 5/1992 | Lipton et al. | 508/188 |
| 5,135,670 | 8/1992 | Johnson et al. | 508/323 |
| 5,262,076 | 11/1993 | Ishida et al. | 508/462 |
| 5,326,488 | 7/1994 | Minokami et al. | 508/542 |
| 5,403,501 | 4/1995 | Schwind | 252/32.7 E |

FOREIGN PATENT DOCUMENTS

| | | |
|---|---|---|
| 531585 | 3/1993 | European Pat. Off. . |
| 578435 | 1/1994 | European Pat. Off. . |
| 620268 | 10/1994 | European Pat. Off. . |

OTHER PUBLICATIONS

Lubrizol Newsline, Jan. 1993, pp. 2–4 "Additive Allows Single Lubricant to Work in Axles and Transmissions".

*Primary Examiner*—Jacqueline V. Howard

*Attorney, Agent, or Firm*—Dennis H. Rainear; Thomas Hamilton

[57] ABSTRACT

In a motor vehicle, especially a heavy duty motor vehicle, having a transmission equipped with at least one cone-type synchronizer and an axle or differential gearing, the same lubricant is used for both such mechanisms. The lubricant has a viscosity grade level of from SAE 75W90 to SAE 85W140 and comprises base oil containing at least (i) Mannich base ashless dispersant; (ii) metal-free, sulphur-containing antiwear and/or extreme pressure agent; (iii) metal-free, phosphorus-containing and nitrogen-containing antiwear and/or extreme pressure agent; and (iv) overbased alkali or alkaline earth metal carboxylate, sulphonate or sulphurized phenate having a TBN of at least 145. The lubricant contains at most, if any, 100 ppm of metal as one or more metal-containing additive components other than (iv).

38 Claims, No Drawings

USE OF TRANSMISSION AND GEAR OIL LUBRICANTS HAVING ENHANCED FRICTION PROPERTIES

REFERENCE TO RELATED APPLICATION

This is a continuation-in-part of application Ser. No. 08/203,817, filed Mar. 1, 1994, now U.S. Pat. No. 5,492,638. The present application and the foregoing earlier application are both owned by the same assignee by unrecorded assignments.

TECHNICAL FIELD

This invention relates to the use in motor vehicles of gear oil lubricants and manual transmission lubricants oils having a well-balanced set of performance characteristics, including enhanced frictional properties. More particularly, this invention relates to a motor vehicle, especially a heavy duty motor vehicle, having a transmission equipped with a cone-type synchronizer and axle or differential gearing wherein the same lubricant composition is used for both such mechanisms.

BACKGROUND

As stated in *Lubrizol Newsline* of January, 1993, page 2 in an article entitled "Additive Allows Single Lubricant To Work in Axles and Transmissions":

"Modern commercial vehicles often must maintain punishing schedules, subjecting their drivetrains to high-speed operation under maximum load for extended periods. Under these conditions, lubricant durability and stability are critical to prevent wear and damaging deposits.

"Also, operating and maintenance costs continue to escalate, making driveline efficiency and reliability prime considerations when selecting a lubricant. Another concern of commercial operators is the cost of stocking and maintaining the different lubricants required for axles and gearboxes, not to mention the problems that could result from accidentally using the wrong lubricant in either component."

The article then refers to the development of an additive that can be used in both mechanisms. Information concerning the composition of the additive is not revealed in the article.

The concept of using the same lubricant composition in the transmission (gearbox) and in the axles (differential) is well established on the North American continent where the overall performance level of the lubricant may be API GL-5. This has been possible because the manual transmissions in North America which are used in heavy duty vehicles are normally not synchronized and therefore are less sensitive to the attack of the API GL-5 level of additive on non-ferrous parts. It is unlikely that this situation will change significantly in the foreseeable future.

In Europe, however, the situation is quite different. In Europe several transmissions use cone-type synchronizers with various surface materials ranging from brass with steel, steel with steel coated with molybdenum, and more recently, steel with steel coated with pyrolytic carbon. The oils currently used are often API GL-4 with demonstrated performance in a synchronizer test such as performed with the ZF test rig. Unfortunately, not all API GL-4 oils give passing performance in such tests. Moreover, most of those oils that do pass synchronizer tests at the API GL-4 level cannot pass at the API GL-5 performance level because the additives are too aggressive toward non-ferrous metals. Another problem in achieving the goal of total drivetrain usage of the same lubricant has been the fact that the heavy duty transmission oils are normally of SAE 80W viscosity grade whereas the axle oils are usually SAE 90 grade oils or even SAE 85W140 grade oils.

U.S. Pat. No. 5,403,501 entitled "Universal Driveline Fluid" refers to the fact that generally when a lubricant is formulated to solve the requirements for a manual transmission, it lacks the necessary extreme pressure protection for hypoid gears, and conversely, when formulated for final drive gear assembly, it often lacks the friction properties necessary for a manual transmission. To satisfy these inconsistent requirements, the patent describes a formulation requiring as one of its components a borated overbased Group I or II metal salt of an organic acid. Such materials require special production methods such as are described in the patent. An important contribution to the art would be a way of satisfying the friction and extreme pressure requirements for total drivetrain or universal driveline usage without requiring any specially prepared additive. In addition, a new way of satisfying the performance requirements of the synchronizer test and the gear or axle performance requirements at least for API GL-4 and preferably for API GL-5 as well would be a most welcome contribution to the art. This invention is deemed to fulfill all of these requirements in a most satisfactory manner.

THE INVENTION

In accordance with one embodiment of this invention, there is provided a method of operating a motor vehicle, especially a heavy duty motor vehicle, having (A) a manual transmission equipped with at least one cone-type synchronizer and (B) differential axle gearing, wherein the same hereinafter-described lubricant composition is used in both such mechanisms (A) and (B). In another embodiment of this invention, there is provided a motor vehicle powered by an internal combustion engine, especially a heavy duty motor vehicle such as a diesel powered truck, and having a drivetrain comprising (A) a manual transmission equipped with a cone synchronizer and (B) differential axle gearing, wherein both of said (A) and said (B) contain the same lubricant composition described hereinafter. Still another embodiment of this invention comprises the method of lubricating the driveline of a motor vehicle powered by an internal combustion engine, especially a heavy duty motor vehicle such as a diesel powered truck, and having a driveline (drivetrain) comprising (A) a manual transmission equipped with a cone synchronizer encased in a housing and (B) differential axle gearing encased in another housing, which method comprises (I) introducing into both of said housings as the lubricants for (A) and (B) the requisite amounts of the same lubricant composition described hereinafter, and (II) sealing said housings so that said lubricant composition is kept therein during ensuing operation of said vehicle.

Other embodiments of this invention will become apparent from a consideration of the ensuing description and appended claims.

The lubricant composition employed in the practice of this invention such as the embodiments described above is of a viscosity grade level of from SAE 75W90 to SAE 85W140 (preferably SAE 80W90) and comprises base oil, which can be 100% of one or more mineral oils or 100% of one or more synthetic oils or any blend of one or more synthetic oils and one or more mineral oils. Preferably a major proportion (by volume) of the base oil is mineral oil. More preferably, at least 80% by volume, still more preferably at least 90% by volume, and most preferably 100% of the base oil is mineral oil. In this connection, the term "base oil" refers to the additive-free lubricating oil with which various additives are blended to achieve the physical properties and performance properties of the finished lubricant composition. Thus if in formulating the finished lubricant composition an additive is included in the base oil that, as received, contains a synthetic oil diluent, such synthetic oil diluent shall not be deemed to constitute part of the base oil even though it becomes part of the overall composition.

Particular mixed blend base oil embodiments of this invention include those wherein the base oil can be or comprise up to about 80% by volume of synthetic ester oil or a blend thereof with mineral oil, with the balance being any other suitable base oil of appropriate lubricating viscosity. It is also possible in the practice of this invention to employ finished lubricants in which all or a portion of the base oil is one or more poly-α-olefin (PAO) oils or fluids of suitable viscosity, with the balance, if any, being synthetic ester oil or more preferably, mineral oil. However from the standpoint of cost, use of mineral oil as the entire base oil is preferred, inasmuch as synthetic oils presently tend to be more expensive than mineral oils.

The additive components present in the finished lubricant composition used pursuant to this invention comprise the combination of (i) one or more Mannich base ashless dispersants, (ii) one or more metal-free sulphur-containing antiwear and/or extreme pressure agents, (iii) one or more metal-free phosphorus-containing and nitrogen-containing antiwear and/or extreme pressure agents, and (iv) one or more overbased alkali or alkaline earth metal carboxylates, sulphonates or sulphurized phenates having a TBN of at least 145 and preferably of at least 200. Another characteristic of the finished lubricant used pursuant to this invention is that the lubricant contains at most, if any, 100 ppm of metal as one or more metal-containing additive components other than said component (iv). Use of finished lubricants in which component (iv) is at least one overbased lithium, sodium, potassium, magnesium and/or calcium carboxylate, sulphonate or sulphurized phenates is preferred, with lubricants containing the overbased calcium carboxylates, sulphonates and calcium sulphurized phenates being particularly preferred. Of the foregoing, finished lubricants in which component (iv) is overbased calcium sulphurized phenate are most preferred. As those skilled in the art are aware, the carboxylates are derived from compounds which contain at least one carboxylic functional group in the molecule. Other functional groups, such as hydroxyl, etc., can also be present in the molecule from which the carboxylates are derived. Thus besides simple salts of mono- or polycarboxylic acids, the term "carboxylates" as used herein (and elsewhere in the art) specifically includes overbased alkali and alkaline earth metal salicylates.

The amount of the overbased alkali and/or alkaline earth metal carboxylate, sulphonate, and/or sulphurized phenate present in the finished oils used pursuant to this invention is an amount that is sufficient to improve the friction properties of the lubricant composition as reflected for example in the Synchronizer Test referred to in more detail hereinafter. Such amount is susceptible to variation depending upon such factors as the type and viscosity of the base oil used in the formulation and the makeup of the particular additive complement utilized therein. For example, if the lubricant has enhanced lubricity because of the presence in the oil of a small amount of a friction modifier system, the amount of the overbased alkali and/or alkaline earth metal component of this invention will normally be somewhat higher than otherwise required. Generally speaking, however, the amount of component (iv) will be such as to provide the following amounts of alkali or alkaline earth metal based on the weight of the finished lubricant:

Lithium: 0.002 to 0.035 wt %, preferably 0.003 to 0.018 wt %, and most preferably 0.004 to 0.018 wt %.

Sodium: 0.007 to 0.115 wt %, preferably 0.010 to 0.058 wt %, and most preferably 0.014 to 0.058 wt %.

Potassium: 0.012 to 0.20 wt %, preferably 0.017 to 0.098 wt %, and most preferably 0.024 to 0.098 wt %.

Magnesium: 0.007 to 0.12 wt %, preferably 0.010 to 0.06 wt %, and most preferably 0.015 to 0.06 wt %.

Calcium: 0.012 to 0.20 wt %, preferably 0.017 to 0.10 wt %, and most preferably 0.025 to 0.1 wt %.

Use can be made of amounts of strontium or barium-containing overbased components yielding proportionate weights of strontium or barium in the finished lubricant (proportionate on an atomic weight basis to the weights listed above for the individual alkali and alkaline earth metal contents of the finished lubricants). The use of strontium and/or barium components is less preferable because of their heavy metal character. When two or more alkali and/or alkaline earth metal overbased carboxylates, sulphonates and/or sulphurized phenates are used, the total amount of these metals provided to the finished oil should also be proportionate on an atomic weight basis to the weights listed above for the individual alkali and alkaline earth metal contents of the finished lubricants.

The finished lubricants used in the practice of this invention typically have a TBN of less than 6 and preferably less than 5. TBN is expressed herein in terms of milligrams of KOH per gram of sample.

The finished lubricant compositions used as the total drive-train lubricants pursuant to this invention provide a multiplicity of beneficial performance results. For one thing, the frictional properties of such lubricants in synchromesh-based transmissions minimize, if not totally eliminate, noisy gear changes. This advantageous result can be readily demonstrated by subjecting the lubricant to standard synchronizer tests such as the test referred to hereinafter as the "Synchronizer Test".

In addition, in the axle gearing mechanism the finished lubricants used pursuant to this invention also exhibit excellent performance characteristics and properties. For example, such finished lubricants formulated to the API GL-4 and GL-5 performance levels for gear lubricant performance exhibit excellent antiwear and extreme pressure performance in the operation of gears under high-speed, shock-load; high-speed, low-torque; and low-speed, high-torque conditions. In addition, such lubricants provide excellent results in the CRC L-60 oxidation stability test, more recently referred to as the "clean-gear test".

Base Oil

Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, hydrotreated oils, partially hydrotreated oils, paraffin oils including pale oils, and solvent extracted naphthenic oils. Such oils and blends of them are produced by a number of conventional techniques which are widely known by those skilled in the art. Small amounts (e.g., 20% by volume or less) of non-ester and non-PAO synthetic oils of suitable viscosity and stability (e.g., suitable hydrogenated polyisobutylene oils) or natural oils of suitable viscosity and stability (e.g., suitable animal or vegetable oils) can be included in the base oil compositions provided that the base oil retains the properties required for use as a base oil for manual transmission and gear usage pursuant to this invention.

Synthetic ester oils which can be used include esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(tridecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, and the complex ester formed by reacting one mole of sebacic acid with two moles of tetraethylene glycol and two moles of 2-ethylhexanoic acid. Other synthetic esters which may be used include those made from $C_3$–$C_{18}$ monocarboxylic acids and polyols and polyol ethers such as neopentyl glycol, trimethylolpropane, pentaerythritol and dipentaerythritol. Trimethylol propane tripelargonate, pentaerythritol tetracaproate, the ester formed from trimethylolpropane, caprylic acid and sebacic acid, and the polyesters derived from a $C_4$–$C_{14}$ dicarboxylic acid and one or more aliphatic dihydric $C_3$–$C_{12}$ alcohols such as derived from azelaic acid or sebacic acid and 2,2,4-trimethyl-1,6-hexanediol serve as examples.

Also useful as base oils or as components of the base oils are hydrogenated or unhydrogenated liquid oligomers of $C_6$–$C_{16}$ α-olefins, such as hydrogenated or unhydrogenated oligomers formed from 1-decene. Methods for producing such liquid oligomeric 1-alkene hydrocarbons are reported in the literature, e.g., U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578. Hydrogenated 1-alkene oligomers of this type, often referred to as PAO fluids, are available as articles of commerce. Blends of such materials can also be used in order to adjust the viscometrics of the given base oil. As is well known, hydrogenated oligomers of this type contain little, if any, residual ethylenic unsaturation. Preferred oligomers are formed by use of a Friedel-Crafts catalyst (especially $BF_3$promoted with water or a $C_{1-20}$ alkanol) followed by catalytic hydrogenation of the oligomer so formed using procedures such as described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

Alkylene oxide polymers and interpolymers and derivatives thereof where the terminal hydroxyl groups have been modified by esterification, etherification, etc., constitute another class of suitable synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1,000, diphenyl ether of polyethylene glycol having a molecular weight of 500–1,000, diethyl ether of polypropylene glycol having a molecular weight of 1,000–1,500) or mono- and poly-carboxylic esters thereof, for example, the acetic acid ester, mixed $C_3$–$C_6$ fatty acid esters, or the $C_{13}$ Oxo acid diester of tetraethylene glycol.

Likewise, various proprietary synthetic lubricants such as KETJENLUBE synthetic oil (Akzo Chemicals) can be employed either as the sole base lubricant or as a component of the base lubricating oil.

Typical vegetable oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, meadowfoam oil, and the like. Such oils may be suitably hydrogenated, if desired.

Blends of one or more mineral oils with one or more synthetic ester oils and/or poly-α-olefin oils can be used. Preferably the base oil is predominantly hydrocarbonaceous in character. As noted above, base oils made up entirely of mineral oils are most preferred.

Ordinarily, the base oil blend will have a kinematic viscosity at 100° C. such that the finished lubricant falls in the range of 4.1 to 41 cSt, and preferably in the range of 7.0 to 24 cSt.

Component (i)—Mannich Base Dispersant

As is well known, Mannich base dispersants are condensation products formed by condensing a long chain hydrocarbon-substituted phenol with one or more aliphatic aldehydes, usually formaldehyde or a formaldehyde precursor, and one or more polyamines, usually one or more polyalkylene polyamines. For use in the practice of this invention, the resultant Mannich base is preferably (but not necessarily) boronated (sometimes called "borated") by reaction with a suitable boron compound such a boron acid, a boron ester, a boron oxide, a salt of a boron acid, a super-boronated ashless dispersant, or the like. It will of course be understood and appreciated that boron is not a metal and thus the amount of boron present in the finished lubricant does not apply to the limitation on the amount of metal other than alkali and alkaline earth metal present in the finished lubricant.

Examples of Mannich condensation products, including in many cases boronated Mannich base dispersants, and methods for their production are described in the following U.S. Pat. Nos.: 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

Preferably, the Mannich base employed includes or, alternatively, consists of boronated Mannich base ashless dispersants.

For further details on this subject, one may refer to EP 531 585.

Component (ii)—Sulphur—Containing Antiwear and/or Extreme Pressure Agent

A variety of oil-soluble metal-free sulphur-containing antiwear and/or extreme pressure additives can be used in the practice of this invention. Examples are included within the categories of dihydrocarbyl polysulphides; sulphurized olefins; sulphurized fatty acid esters of both natural and synthetic origins; trithiones; sulphurized thienyl derivatives; sulphurized terpenes; sulphurized oligomers of $C_2$–$C_8$ monoolefins; and sulphurized Diels-Alder adducts such as those disclosed in reissue U.S. Pat. No. Re 27,331. Specific examples include sulphurized polyisobutene of $\overline{M}n$ 1,100, sulphurized isobutylene, sulphurized diisobutylene, sulphurized triisobutylene, dicyclohexyl polysulphide, diphenyl polysulphide, dibenzyl polysulphide, dinonyl polysulphide, and mixtures of di-tert-butyl polysulphide such as mixtures of di-tert-butyl trisulphide, di-tert-butyl tetrasulphide and di-tert-butyl pentasulphide, among others.

Combinations of such categories of sulphur-containing antiwear and/or extreme pressure agents can also be used, such as a combination of sulphurized isobutylene and di-tert-butyl trisulphide, a combination of sulphurized isobutylene and dinonyl trisulphide, a combination of sulphurized tall oil and dibenzyl polysulphide, and the like.

Reference should be made to EP 531 585 cited above for further details concerning this component.

Component (iii)—Phosphorus-Containing Antiwear and/or Extreme Pressure Agent

For purposes of this invention a component which contains both phosphorus and sulphur in its chemical structure is deemed a phosphorus-containing antiwear and/or extreme pressure agent rather than a sulphur-containing antiwear and/or extreme pressure agent.

Although use can be made of a wide variety of oil-soluble substances such as the oil-soluble organic phosphates, organic phosphites, organic phosphonates, organic phosphonites, etc., and their sulphur analogs, the preferred phosphorus-containing antiwear and/or extreme pressure agents for use in the compositions of this invention are those which contain both phosphorus and nitrogen.

One such type of phosphorus- and nitrogen-containing antiwear and/or extreme pressure additives which can be employed in the practice of this invention are the phosphorus- and nitrogen-containing compositions of the type described in G.B. 1,009,913; G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine.

Another type of phosphorus- and nitrogen-containing antiwear and/or extreme pressure additive which can be used in the compositions of this invention is the amine salts of hydroxy-substituted phosphetanes or the amine salts of hydroxy-substituted thiophosphetanes. Typically, such salts are derived from compounds of the formula

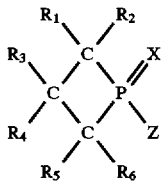

wherein each of $R_1$, $R_2$, $R_3$, $R_4$, $R_5$ and $R_6$ is a hydrogen atom or a carbon-bonded organic group such as a hydrocarbyl group or a substituted hydrocarbyl group wherein the substituent(s) do(es) not materially detract from the predominantly hydrocarbonaceous character of the hydrocarbyl group; X is a sulphur or an oxygen atom and Z is a hydroxyl group or an organic group having one or more acidic hydroxyl groups. Examples of this general type of antiwear and/or extreme pressure agent include the amine salts hydroxyphosphetanes and the amine salts of hydroxythiophosphetanes typified by Irgalube 295 additive (Ciba-Geigy Corporation).

Another useful category of phosphorus- and nitrogen-containing antiwear and/or extreme pressure agents is comprised of the amine salts of partial esters of phosphoric and thiophosphoric acids. The phosphoric and thiophosphoric acids have the formula $$(HX^1)(HX^2)(HX^3)PX^4$$

wherein each of $X^1$, $X^2$, $X^3$ and $X^4$ is, independently, an oxygen atom or a sulphur atom, and most preferably wherein at least three of them are oxygen atoms.

For further details concerning this component, reference should be had to EP 531 585 referred to above.

Component (iv)—Overbased Alkali and Alkaline Earth Metal Carboxylate, Sulphonate and/or Sulphurized Phenate As pointed out above these components should have a TBN of at least 145 and preferably at least 200 milligrams of KOH per gram of product. More preferably, the TBN of the overbased alkali or alkaline earth metal component is at least 240 and can be as high as 500 to 600 depending upon the makeup of the component. The carboxylates can be alkali or alkaline earth metal salts of alkyl succinic acids or alkenyl succinic acids in which the alkyl or alkenyl substituent contains an average of from 50 to 300 carbon atoms such as a polypropenyl group, a polyisobutenyl group, or the like. Another highly useful type of alkali or alkaline earth metal carboxylate is the alkali and alkaline earth metal salicylates. The overbased sulphonates are exemplified by overbased alkali and alkaline earth metal petroleum sulphonates (sometimes referred to as "mahogany sulphonates") and overbased alkali and alkaline earth metal alkylaryl sulphonates such as the alkylbenzene sulphonates and the alkylnaphthalene sulphonates. The overbased sulphurized phenates are typically derivatives of alkylphenols having an alkyl substituent of sufficient chain length (usually $C_8$ or above) to confer suitable oil solubility. Methods for the manufacture of the foregoing overbased alkali and alkaline earth metal carboxylates, sulphonates and sulphurized phenates are extensively reported in the literature. See for example U.S. Pat. Nos. 4,647,387 4,664,824; 4,698,170; 4,710,308; 4,744,920; 4,744,921; 4,749,499; 4,758,360; 4,775,490; 4,780,224; 4,810,396; 4,810,398; 4,822,502; 4,865,754; 4,869,837; 4,979,053; 4,880,550; 4,929,373; 4,954,272; 4,971,710; 4,973,411; 4,995,993; 4,997,584; 5,011,618; 5,013,463; 5,024,773; 5,030,687; 5,032,299; 5,035,816; 5,069,804; 5,089,155; 5,098,587; 5,108,630; 5,108,631; 5,112,506; 5,132,033; and 5,137,648. Overbased alkaline earth metal calixerates such as described in U.S. Pat. No. 5,114,601 may also be used.

Typically this component will contain as the metal constituent thereof, Li, Na, K, Mg, Ca, and/or Ba. Since this component is boron-free, no new special production process is required for its synthesis. Suitable overbased materials are readily available as articles of commerce from a number of commercial sources.

The standard method for determining TBN involves a titration with strong acid. Thus for a given overbased alkali or alkaline earth metal component such as high base phenate, the TBN of, say, 250 really is 150 plus 100.

Other Additives

The preferred lubricant compositions used in the practice of this invention will also contain one or more additional components such as one or more amine salts of carboxylic acids, amines, trihydrocarbyl dithiophosphates, carboxylic acids, demulsifiers, copper corrosion inhibitors or passivators, supplemental ashless dispersants, antioxidants, rust inhibitors, antifoam agents, seal swell agents, viscosity index improvers, pour point depressants, other metal corrosion inhibitors, and the like. In selecting such materials, care should be taken to ensure that the components are mutually compatible with each other and are essentially metal-free so that the finished lubricant contains no more than 100 ppm, if any, of metal other than the alkali and/or alkaline earth metal of the overbased component (iv). For further details concerning suitable additives of the foregoing type, reference should be had to EP 531 585 referred to above.

Proportions and Concentrations

In general, the components of the lubricant compositions used pursuant to this invention are employed in minor amounts sufficient to improve the performance characteristics and properties of the base oil or fluid. Generally speaking, the following concentrations (weight percent) of the components (active ingredients, i.e., excluding diluents which often are associated therewith) in the base oils or fluids are illustrative:

| | Typical Range | Preferred Range |
|---|---|---|
| Mannich base | 0.1–4 | 0.2–3 |
| S-contg antiwear/E.P. agent | 0.1–6 | 1–4 |
| P-contg antiwear/E.P. agent | 0.1–3 | 0.1–2 |
| Amine salt of carboxylic acid | 0–2 | 0.01–1 |
| Free amine | 0–2 | 0–1 |
| Trihydrocarbyl dithiophosphate | 0–3 | 0–2 |
| Demulsifier | 0–1 | 0–0.2 |
| Cu corrosion inhibitor | 0–0.5 | 0.01–0.2 |
| Other P-antiwear/E.P. agent | 0–0.7 | 0.05–0.4 |
| Supplemental ashless dispersant | 0–3 | 0–2 |
| Antioxidant | 0–2 | 0–1 |
| Supplemental rust inhibitor | 0–2 | 0.02–1 |
| Antifoam agent | 0–0.3 | 0.0002–0.1 |
| Friction modifier | 0–3 | 0–1 |
| Seal swell agent | 0–20 | 0–10 |
| Viscosity index improver | 0–40 | 0–30 |
| Pour point depressant | 0–3 | 0–2 |
| Other metal corrosion inhibitors | 0–1 | 0–0.5 |

In some cases because of potential variabilities in molecular weight, the typical range and preferred range of proportions (active ingredient basis) for the Mannich base may be 0.1 to 3 wt % and 0.2 to 2 wt %, respectively. For the same reason and again on an active ingredient basis, the typical and preferred ranges, respectively, for the viscosity index improver in some cases may be 0 to 20 wt % and 0 to 15 wt %, and for the pour point depressant in some cases may be 0 to 2 wt % and 0 to 1 wt %. With some synthetic base oils such as PAO base oils the amount of viscosity index improver can be as high as 60% by weight.

It is to be noted that some additives are multifunctional additives capable of contributing more than a single property to the blend in which they are used. Thus when employing a multifunctional additive component in the compositions of this invention, the amount used should of course be sufficient to achieve the function(s) and result(s) desired therefrom.

In most cases the individual components can be separately blended into the base oil or fluid or can be blended therein in various subcombinations, if desired. However when oil-soluble aliphatic primary amine salts of dihydrocarbyl monothiophosphoric acids are utilized as component (iii) they should either be preformed, or formed in situ, by use of certain synthesis procedures. Preferably, such compounds are made by reacting a dihydrocarbyl phosphite with sulphur or an active sulphur-containing compound such as an active sulphur-containing sulphurized olefin and one or more primary aliphatic amines. Such reactions tend to be highly exothermic reactions which can become uncontrollable, if not conducted properly. The preferred method of forming these amine salts involves a process which comprises (i) introducing, at a rate such that the temperature does not exceed about 60° C., one or more dihydrocarbyl hydrogen phosphites, such as a dialkyl hydrogen phosphite, into an excess quantity of one or more active-sulphur-containing materials, such as sulphurized branched-chain olefin (e.g., isobutylene, diisobutylene, triisobutylene, etc.), while agitating the mixture so formed, (ii) introducing into this mixture, at a rate such that the temperature does not exceed about 60° C., one or more aliphatic primary monoamines having in the range of about 8 to about 24 carbon atoms per molecule while agitating the mixture so formed, and (iii) maintaining the temperature of the resultant agitated reaction mixture at between 55° to 60° C. until reaction is substantially complete. Another suitable way of producing these amine salts is to concurrently introduce all three of the reactants into the reaction zone at suitable rates and under temperature control such that the temperature does not exceed 65° C. Still another suitable way of producing these amine salts is to charge the sulphurized branched chain olefin with stirring into a dihydrocarbyl hydrogen phosphite and then charge the amine at suitable rates while controlling the temperature so that it does not exceed 60°–65° C.

Another way of forming the finished lubricants is to blend the components into the base oil in the form of separate solutions in a diluent. Another variant is to employ a so-called top treat wherein one or more components such as the alkali and/or alkali earth metal overbased component (iv) are added to the base oil separately from an additive concentrate containing other components desired in finished oil. Except for viscosity index improvers and/or pour point depressants (which in many instances are blended apart from other components), it is preferable to blend the other selected components into the base oil by use of an additive concentrate, as this simplifies the blending operations, reduces the likelihood of blending errors, and takes advantage of the compatibility and solubility characteristics afforded by the overall concentrate.

The additive concentrates will contain the individual components in amounts proportioned to yield finished oil or fluid blends consistent with the concentrations tabulated above. In most cases, the additive concentrate will contain one or more diluents such as light mineral oils, to facilitate handling and blending of the concentrate. Thus concentrates containing up to 80% by weight of one or more diluents or solvents can be used.

Synchronizer Test

Tests have been designed for the evaluation of oil performance in commercially available synchromesh units under endurance conditions with the bulk lubricant temperature controlled at a relatively high level. While it is important to simulate fairly closely the actual conditions met in service, the need to produce a test result in an acceptable period had to be taken into account. In these tests, two halves of a transmission synchromesh unit are repeatedly brought together under conditions of known force and speed differential until failure occurs. Failure may be defined in terms of synchromesh performance or overall wear. Test rigs used in the procedure have been designed with consideration of work done by Socin and Walters, SAE Paper Number 680008 entitled "Manual Transmission Synchronizers"; Fano, CEC TLPG4 Chairman's Final Report, 1985, entitled "Synchromesh Test Method With Proposed Synchro Test Rig"; and Brugen, Thies and Naurian of Zahnradfabrik Friedrichshafen A. G. in a paper entitled "Einfluss Des Schmierstoffes auf die Schaltelemente Von Fahrzeuggetrieben". In the test apparatus, the two synchromesh units are assembled in a gear box which forms the oil reservoir and facilitates splash lubrication of components. Drive may be transmitted along the main shaft or via the layshaft gears to give an increased ratio. The input speed is kept constant by means of a DC drive control system and a large flywheel simulating vehicle inertia. On changing gear, the output shaft accelerates and decelerates the small flywheel which simulates clutch inertia. A pivot linkage connected to a pneumatic cylinder provides the actuating force which is measured by means of a load ring strain gauge. A small heater is used to control oil temperature.

Torque transmitted through the output shaft can be measured to give an indication of the coefficient of friction between the synchronizing cones. The synchromesh units used are standard commercially available steel units with a molybdenum-based plasma spray coating on the inner surface of the outer synchro ring. The coefficient of friction for satisfactory synchronizer performance in the test is at least 0.065.

Another performance criterion which may be used when performing the test for qualification purposes is bad gear changes as determined by analysis of torque data. For this purpose the control and monitoring of the rig is coordinated by a process controller. During a test, the number of bad changes is recorded. The test is terminated prematurely if this number becomes unacceptable.

The following examples illustrate the practice and advantages of this invention. These examples, in which all parts and percentages are by weight unless otherwise specified, are not intended to limit, and should not be construed as limiting, the practice or scope of this invention.

EXAMPLES

Tests were carried out using the Synchronizer Test procedure and utilizing a group of gear oils in which, except for the identity and quantity if any of overbased component (iv) employed, the additive complement was kept uniform from test to test. The uniform, non-varied portion of the additive complement was an additive concentrate containing 9.33% of a mineral oil concentrate containing 48% of boronated Mannich ashless dispersant; 6.26% of trihydrocarbyl dithiophosphate; 0.50% of antifoam agent; 0.31% of demulsifying agents; 1.20% of copper corrosion inhibitor; 20.83% of process oil diluent; and a mixture of sulphurized isobutylene, amine salts of dibutyl monothiophosphoric acid, amine carboxylates, amine salts of mono- and dialkylphosphoric acid and amines formed by interactions among 44.00% of sulphurized isobutylene, 5.33% of dibutyl hydrogen phosphite, 1.94% of 2-ethylhexyl acid phosphate, 7.80% of aliphatic primary monoamines, and 2.50% of aliphatic monocarboxylic acids. For the tests involving API GL-4 gear oil, the above concentrate was employed at a concentration of 3.75% in the base oil. For API GL-5 service, the additive concentrate was employed at a treat rate of 7.50%. The base oil used in these tests was high viscosity index 115 solvent neutral base oil (Shell Oil Company) containing 1% of poly(alkyl methacrylate) pour point depressant.

Example 1 (Comparative)

In a control run wherein the additive package was employed at the API GL-4 concentration level, and without use of an overbased alkali or alkaline earth metal component (iv) of this invention, the Synchronizer Test was terminated after 406 cycles during which 20 bad gear changes had occurred.

Example 2

When 0.15% of overbased calcium sulphurized alkyl phenate in the form of a 62% solution in oil having a nominal TBN of 255, a nominal calcium content of 9.25%, and a nominal sulphur content of 3.4% was included in the composition of Example 1, the finished lubricant successfully completed 5,000 cycles in the Synchronizer Test with no bad gear changes.

Examples 3–5 and Example 6 (Comparative)

The procedure of Example 2 was repeated except that the additive package was employed at the API GL-5 dosage level and the overbased calcium sulphurized alkyl phenate solution was employed at dosage levels of 0.30%, 0.35% and 0.50%. In each of these three runs, the lubricants successfully completed 5,000 cycles in the Synchronizer Test with no bad gear changes. It was found in a similar run that the dosage level of 0.20% for the overbased calcium sulphurized alkyl phenate was insufficient to achieve 5,000 cycles of trouble-free gear changes when the additive concentrate was employed at the API GL-5 dosage level.

Example 7

The procedure of Example 2 was repeated with the exception that 0.10% of overbased calcium alkyl benzene sulphonate was employed. This material was in the form of a 56% solution in mineral oil and had a nominal TBN of 307, a nominal calcium content of 11.90%, and a nominal sulphur content of 1.70%. This blend achieved 4,539 cycles with 27 bad gear changes and thus the dosage level was less than that needed to achieve trouble-free performance.

Example 8 (Comparative)

The procedure of Example 1 was repeated and in this instance the gear oil formulation was discontinued after 244 cycles with 14 bad gear changes.

Example 9

The procedure of Example 8 was repeated except that 0.50% of the overbased calcium alkyl benzene sulphonate of Example 7 was included in the finished oil composition. In this case, the lubricant successfully passed 5,000 cycles with no bad gear changes having been experienced.

Examples 10–19

Additional testing using a modified Synchronizer Test was carried out using 10 samples of different finished lubricants in which the base oils were entirely mineral oils obtained from Shell Oil Company. The chief variables in these tests were the presence or absence of an overbased calcium sulphurized phenate with a nominal TBN of 255, the concentration of the phenate when used, and the amounts of the additive concentrate used (i.e., whether at the API GL-4 level of 3.75 percent or at the API GL-5 level of 7.50 percent). The additive concentrates were substantially the same as that used in Examples 1–9 above with minor variations which were inconsequential insofar as the practice of this invention is concerned. The concentrates ("Conc") are referred to hereinafter as A, B, and C. All finished lubricants used in these tests were SAE 80W viscosity grade except Example 19 which was an SAE 85W90 lubricant. Results of these tests are summarized in the table.

TABLE

| Ex. | Conc. | Conc., % | Phenate, % | No. Cycles to Failure |
|---|---|---|---|---|
| 10 | A | 3.75 | 0 | 12,485 |
| 11 | B | 3.75 | 0 | 4,055 |
| 12 | B | 7.50 | 0 | 2,902 |
| 13 | B | 3.75 | 0.2 | 14,575 |
| 14 | B | 3.75 | 0.3 | >50,000 |
| 15 | B | 3.75 | 0.4 | >50,000 |
| 16 | B | 3.75 | 0.5 | >50,000 |
| 17 | B | 3.75 | 0.3 | >50,000 |
| 18 | C | 3.75 | 0.3 | >50,000 |
| 19 | C | 7.50 | 0.75 | >50,000 |

The excellent performance achievable by the practice of this invention was further demonstrated in wear tests conducted in a planetary gear test rig operated under heavy duty conditions. In these tests, samples of the test oil were periodically taken and analyzed for iron content. The test was terminated when a sharp rise in iron content or tooth breakage occurred. Thus the longer the time required to reach a sharp rise in iron content or tooth breakage, the better the performance of the lubricant.

Two 85W90 total drivetrain oils made from the same base oils were subjected to this test procedure. One was a lubricant used pursuant to this invention which contained additive concentrate C at the API GL-5 level of 7.50 wt %, and 1.0 wt % an overbased calcium sulphurized phenate with a nominal TBN of 255. For comparative purposes, the other lubricant used in the test contained a commercially-available additive package, also at the recommended API GL-5 level.

The total drivetrain oil with the commercial API GL-5 package terminated after 113 hours of operation. The lubricant pursuant to this invention terminated at 177 hours of operation.

It will be understood and appreciated that the additive components utilized in the compositions employed in practicing this invention should be oil-soluble. By this is meant the component in question has sufficient solubility in the selected base oil in order to dissolve therein at ordinary temperatures to a concentration at least equivalent to the minimum concentration specified herein for use of such component. Preferably, however, the solubility of such component in the selected base oil will be in excess of such minimum concentration, although there is no requirement that the component be soluble in the base oil in all proportions. As is known to those skilled in the art, certain useful additives do not completely dissolve in base oils but rather are used in the form of stable suspensions or dispersions. Additives of this type can be employed in the compositios of this invention, provided they remain stably dispersed in the finished oil and do not significantly interfere with the performance or usefulness of the composition in which they are employed.

As is well known to those skilled in the art, overbased alkali and alkaline earth metal detergent materials such as the carboxylates, sulphonates, and sulphurized phenates, are provided in the form of oil solutions or concentrates. It will thus be appreciated that all references herein to the TBN of these materials is with reference to the solutions or concentrates as received.

It will be appreciated that by "the same" in connection with the lubricant composition used in both the transmission housing (or casing) and the axle gearing housing (or casing) is meant that both housings are charged to their appropriate levels with the same initial lubricant composition whether from the same or different containers and irrespective of compositional changes that may occur during usage.

This invention is susceptible to considerable variation in its practice. Accordingly, this invention is not intended to be limited by the specific exemplifications set forth hereinabove. Rather, this invention is intended to cover the subject matter within the spirit and scope of the appended claims and the permissible equivalents thereof.

We claim:

1. A method of operating a motor vehicle having (A) a manual transmission equipped with at least one cone-type synchronizer and (B) differential axle gearing, which comprises employing the same lubricant composition to lubricate both said mechanisms (A) and (B), said lubricant composition having a viscosity grade level of from SAE 75W90 to SAE 85W140 and comprising base oil, and minor amounts of at least the following components: (i) at least one Mannich base ashless dispersant; (ii) at least one metal-free, sulphur-containing antiwear and/or extreme pressure agent; (iii) at least one metal-free, phosphorus-containing and nitrogen-containing antiwear and/or extreme pressure agent; and (iv) at least one overbased alkali or alkaline earth metal carboxylate, sulphonate or sulphurized phenate having a TBN of at least 145; said lubricant composition containing at most, if any, 100 ppm of metal as one or more metal-containing additive components other than said component (iv).

2. The method of claim 1 wherein said TBN is at least 200.

3. The method of claim 1 wherein said base oil is (a) one or more mineral oils, or (b) one or more poly-α-olefin oils, or (c) one or more synthetic ester oils, or any combination of any two of (a), (b) and (c), or of all three of (a), (b) and (c).

4. The method of claim 3 wherein said TBN is at least 200.

5. The method of claim 1 wherein at least 80% by volume of said base oil is mineral oil or synthetic ester oil or a blend thereof.

6. The method of claim 1 wherein said base oil is mineral oil.

7. The method of claim 1 wherein said Mannich base ashless dispersant is a boronated Mannich base ashless dispersant.

8. The method of claim 1 wherein said metal-free, sulphur-containing antiwear and/or extreme pressure agent is a sulphurized olefin.

9. The method of claim 1 wherein said metal-free, phosphorus-containing and nitrogen-containing antiwear and/or extreme pressure agent is at least one amine salt of a dihydrocarbyl monothiophosphoric acid.

10. The method of claim 1 wherein the metal of said overbased alkali or alkaline earth metal carboxylate, sulphonate or sulphurized phenate is lithium, sodium, potassium, magnesium, calcium and/or barium.

11. The method of claim 1 wherein said Mannich base ashless dispersant is a boronated Mannich base ashless dispersant, and wherein said metal-free, sulphur-containing antiwear and/or extreme pressure agent is a sulphurized olefin.

12. The method of claim 11 wherein said metal-free, phosphorus-containing and nitrogen-containing antiwear and/or extreme pressure agent is at least one amine salt of a dihydrocarbyl monothiophosphoric acid.

13. The method of claim 1 wherein said component (iv) is an overbased calcium sulphurized alkyl phenate having a TBN of at least 240 or an overbased calcium alkylbenzene sulphonate having a TBN of at least 300.

14. The method of claim 13 wherein said Mannich base ashless dispersant is a boronated Mannich base ashless dispersant, and wherein said metal-free, sulphur-containing antiwear and/or extreme pressure agent is a sulphurized olefin.

15. The method of claim 14 wherein said metal-free, phosphorus-containing and nitrogen-containing antiwear and/or extreme pressure agent is at least one amine salt of a dihydrocarbyl monothiophosphoric acid.

16. The method of claim 1 which further comprises a plurality of components selected from the following: at least one amine salt of a carboxylic acid, at least one amine, at least one trihydrocarbyl dithiophosphate, at least one carboxylic acid, at least one demulsifier, at least one copper corrosion inhibitor or passivator, at least one supplemental ashless dispersant, at least one antioxidant, at least one rust inhibitor, at least one antifoam agent, at least one seal swell agent, at least one viscosity index improver, at least one pour point depressant, at least one metal corrosion inhibitor other than a rust inhibitor or a copper corrosion inhibitor or passivator.

17. The method of claim 1 wherein said base oil is mineral oil; wherein said Mannich base ashless dispersant is a boronated Mannich base ashless dispersant; wherein said metal-free, sulphur-containing antiwear and/or extreme pressure agent is a sulphurized olefin; wherein said metal-free, phosphorus-containing and nitrogen-containing antiwear and/or extreme pressure agent is at least one amine salt of a dihydrocarbyl monothiophosphoric acid; and wherein said component (iv) is an overbased calcium sulphurized alkyl phenate having a TBN of at least 240 or an overbased calcium alkylbenzene sulphonate having a TBN of at least 300.

18. The method of claim 1 wherein at least one said cone-type synchronizer has interacting surfaces composed of materials that differ from each other, at least one of said surfaces being other than a ferrous metal.

19. The method of claim 18 wherein said base oil is mineral oil; wherein said Mannich base ashless dispersant is a boronated Mannich base ashless dispersant; wherein said metal-free, sulphur-containing antiwear and/or extreme pressure agent is a sulphurized olefin; wherein said metal-free, phosphorus-containing and nitrogen-containing antiwear and/or extreme pressure agent is at least one amine salt of a dihydrocarbyl monothiophosphoric acid; and wherein said component (iv) is an overbased calcium sulphurized alkyl phenate having a TBN of at least 240.

20. A method of lubricating the driveline of a motor vehicle powered by an internal combustion engine and having a driveline comprising (A) a manual transmission equipped with at least one cone-type synchronizer encased in a housing therefor constructed and adapted to hold a fluid lubricant for said transmission, and (B) differential axle gearing encased in a housing therefor constructed and adapted to hold a fluid lubricant for said gearing, which method comprises (I) introducing into both of said housings as the lubricants for said transmission and for said gearing, the requisite respective amounts of the same lubricant composition, and (II) sealing said housings so that said lubricant composition is kept therein during ensuing operation of said vehicle, said lubricant composition having a viscosity grade level of from SAE 75W90 to SAE 85W140 and comprising base oil, and minor amounts of at least the following components: (i) at least one Mannich base ashless dispersant; (ii) at least one metal-free, sulphur-containing antiwear and/or extreme pressure agent; (iii) at least one metal-free, phosphorus-containing and nitrogen-containing antiwear and/or extreme pressure agent; and (iv) at least one overbased alkali or alkaline earth metal carboxylate, sulphonate or sulphurized phenate having a TBN of at least 145; said lubricant composition containing at most, if any, 100 ppm of metal as one or more metal-containing additive components other than said component (iv) .

21. The method of claim 20 wherein said TBN is at least 200.

22. The method of claim 20 wherein said base oil is (a) one or more mineral oils, or (b) one or more poly-α-olefin oils, or (c) one or more synthetic ester oils, or any combination of any two of (a), (b) and (c), or of all three of (a), (b) and (c).

23. The method of claim 22 wherein said TBN is at least 200.

24. The method of claim 20 wherein at least 80% by volume of said base oil is mineral oil or synthetic ester oil or a blend thereof.

25. The method of claim 20 wherein said base oil is mineral oil.

26. The method of claim 20 wherein said Mannich base ashless dispersant is a boronated Mannich base ashless dispersant.

27. The method of claim 20 wherein said metal-free, sulphur-containing antiwear and/or extreme pressure agent is a sulphurized olefin.

28. The method of claim 20 wherein said metal-free, phosphorus-containing and nitrogen-containing antiwear and/or extreme pressure agent is at least one amine salt of a dihydrocarbyl monothiophosphoric acid.

29. The method of claim 20 wherein the metal of said overbased alkali or alkaline earth metal carboxylate, sulphonate or sulphurized phenate is lithium, sodium, potassium, magnesium, calcium and/or barium.

30. The method of claim 20 wherein said Mannich base ashless dispersant is a boronated Mannich base ashless dispersant, and wherein said metal-free, sulphur-containing antiwear and/or extreme pressure agent is a sulphurized olefin.

31. The method of claim 30 wherein said metal-free, phosphorus-containing and nitrogen-containing antiwear and/or extreme pressure agent is at least one amine salt of a dihydrocarbyl monothiophosphoric acid.

32. The method of claim 20 wherein said component (iv) is an overbased calcium sulphurized alkyl phenate having a TBN of at least 240 or an overbased calcium alkylbenzene sulphonate having a TBN of at least 300.

33. The method of claim 32 wherein said Mannich base ashless dispersant is a boronated Mannich base ashless dispersant, and wherein said metal-free, sulphur-containing antiwear and/or extreme pressure agent is a sulphurized olefin.

34. The method of claim 33 wherein said metal-free, phosphorus-containing and nitrogen-containing antiwear and/or extreme pressure agent is at least one amine salt of a dihydrocarbyl monothiophosphoric acid.

35. The method of claim 20 which further comprises a plurality of components selected from the following: at least one amine salt of a carboxylic acid, at least one amine, at least one trihydrocarbyl dithiophosphate, at least one carboxylic acid, at least one demulsifier, at least one copper corrosion inhibitor or passivator, at least one supplemental ashless dispersant, at least one antioxidant, at least one rust inhibitor, at least one antifoam agent, at least one seal swell agent, at least one viscosity index improver, at least one pour point depressant, at least one metal corrosion inhibitor other than a rust inhibitor or a copper corrosion inhibitor or passivator.

36. The method of claim 20 wherein said base oil is mineral oil; wherein said Mannich base ashless dispersant is a boronated Mannich base ashless dispersant; wherein said metal-free, sulphur-containing antiwear and/or extreme pressure agent is a sulphurized olefin; wherein said metal-free, phosphorus-containing and nitrogen-containing antiwear and/or extreme pressure agent is at least one amine salt of a dihydrocarbyl monothiophosphoric acid; and wherein said component (iv) is an overbased calcium sulphurized alkyl phenate having a TBN of at least 240 or an overbased calcium alkylbenzene sulphonate having a TBN of at least 300.

37. The method of claim 20 wherein said cone synchronizer has interacting surfaces composed of materials that differ from each other, at least one of said surfaces being other than a ferrous metal.

38. The method of claim 37 wherein said base oil is mineral oil; wherein said Mannich base ashless dispersant is a boronated Mannich base ashless dispersant; wherein said metal-free, sulphur-containing antiwear and/or extreme pressure agent is a sulphurized olefin; wherein said metal-free, phosphorus-containing and nitrogen-containing antiwear and/or extreme pressure agent is at least one amine salt of a dihydrocarbyl monothiophosphoric acid; and wherein said component (iv) is an overbased calcium sulphurized alkyl phenate having a TBN of at least 240.

* * * * *